United States Patent [19]

Julius

[11] Patent Number: 5,057,210

[45] Date of Patent: Oct. 15, 1991

[54] APPARATUS FOR SEPARATING NON-MAGNETIZABLE METALS FROM A SOLID MIXTURE

[75] Inventor: Jörg Julius, Düsseldorf, Fed. Rep. of Germany

[73] Assignee: Lindemann Maschinenfabrik GmbH

[21] Appl. No.: 483,240

[22] Filed: Feb. 22, 1990

[30] Foreign Application Priority Data

Mar. 1, 1989 [DE] Fed. Rep. of Germany ..... 3906422

[51] Int. Cl.[5] ..... B03C 1/02

[52] U.S. Cl. ..... 209/212; 209/216; 209/219

[58] Field of Search ..... 209/212, 216, 225, 219, 209/11, 223.11; 198/841

[56] References Cited

U.S. PATENT DOCUMENTS

| | | | |
|---|---|---|---|
| 2,748,940 | 6/1956 | Roth | 209/219 |
| 3,448,857 | 6/1969 | Benson et al. | 209/219 |
| 4,031,004 | 6/1977 | Sommer et al. | 209/212 |
| 4,206,994 | 6/1980 | Silverberg et al. | 198/841 X |
| 4,743,364 | 5/1988 | Kyrazis | 209/212 |
| 4,834,870 | 5/1989 | Osterberg et al. | 209/212 |

FOREIGN PATENT DOCUMENTS

| | | | |
|---|---|---|---|
| 0106675 | 4/1984 | European Pat. Off. | 209/219 |
| 0342330 | 11/1989 | European Pat. Off. | 209/212 |
| 3416504 | 11/1986 | Fed. Rep. of Germany . | |

*Primary Examiner*—Donald T. Hajec

*Attorney, Agent, or Firm*—Toren, McGeady

[57] ABSTRACT

The operation of an apparatus for separating non-magnetizable metals, in particular non-ferrous metals, from a solid mixture by means of an alternating magnetic field is improved and the construction of the apparatus simplified by arranging the magnetic field generator adjacent to a straight, curved or bent slideway of a material of poor electrical conductivity.

23 Claims, 4 Drawing Sheets

APPARATUS FOR SEPARATING NON-MAGNETIZABLE METALS FROM A SOLID MIXTURE

TECHNICAL FIELD OF THE INVENTION

The invention relates to an apparatus for separating non-magnetizable metals, in particular non-ferrous metals, from a solid mixture by means of a magnetic field generator.

BACKGROUND OF THE INVENTION AND PRIOR ART

With such an apparatus so-called eddy current separation can be carried out. The material is conveyed over the poles of an alternating magnetic field generator, for example on a conveyor or in free fall. By this means eddy currents are induced in the electrically conductive components of the mixture which build up their own magnetic fields opposed to the generating field and thereby accelerate these components, through electromagnetic forces, relative to the other components of the mixture. Non-ferromagnetic materials of good electrical conductivity, such as aluminium and copper, can be separated from non-ferrous solid mixtures and non-ferrous metal/non-metal solid mixtures, such as car shredder scrap or electronic scrap metal by means of eddy current separation. Should there be ferromagnetic fractions in this material a magnetic separator can be arranged before the eddy current separator to first remove ferromagnetic fractions. In addition other sorting and classifying stages are advantageously arranged before the eddy current separation because pre-enrichment and fractionation of the charged solid mixture to the greatest possible extent has a good effect on the success of separation.

In a separating apparatus known from DE-OS 34 16 504, in order to separate the ferromagnetic fraction a solid mixture is first transported by means of a conveyor belt beneath a magnetic separator and thereafter fed from the conveyor belt to the outside of a slowly rotating drum to separate out the non-ferrous metals. Arranged concentrically in the interior of the drum is a rapidly rotating rotor fitted with permanent magnets. The permanent magnets extend uniformly parallel to the rotor axis and are arranged at a large distance from one another so that the magnetic field forming between the poles of the permanent magnets acts as far as possible outside of the drum. In comparison to other eddy current separating processes this known apparatus is said to enable higher throughput to be obtained with thicker layers of the solid mixture because the separating forces of the alternating magnetic field already act on the solid mixture at the time when the forces of gravity have no or only a little effect.

However, with this known apparatus there is mutual interference if the material particles go beyond the radius of the drum into their trajectory parabola. On the one hand conductive particles to be diverted are retarded by the non-conductive particles and on the other hand non-conductive particles are accelerated undesirably owing to the contact with the conductive non-ferrous metal particles. As a result it is not possible to avoid misplaced materials in both the products, i.e. electrically non-conductive particles discharged into the collecting region of the non-ferrous metal particles and vice versa. Apart from this, accommodating the magnetic rotor in the space in the drum presents considerable problems; these involve both constructional and manufacturing difficulties. Thus the magnetic rotor must be mounted in the restricted space within the preferably rotatable drum, the diameter of which cannot be increased at will, and the mounting becomes still more complicated if the magnetic rotor is to be adjustable, for example concentrically around a radius or on a curve at different radial distances from the axis of rotation of the drum.

Furthermore the drum can only be manufactured or machined with difficulty and requires extremely accurate finishing to obtain desired thin, uniform wall thicknesses of the drum with high mechanical stability so that as far as is possible no magnetic force is lost. For example there must not be differences in the hardness of the material in the surface of the drum, i.e. no softer or harder areas must arise as a result of which the very small air gap between the magnetic rotor and the drum might be locally reduced so that serious damage resulting from frictional contact between the magnetic rotor and the drum could occur.

OBJECT OF THE INVENTION

It is an object of the invention to provide an apparatus which is both constructionally simple and allows improved separation in particular of non-ferrous metals from a solid mixture to be achieved.

SUMMARY OF THE INVENTION

To this end, with an apparatus of the kind mentioned in the introduction, according to the invention the magnetic field generator is arranged beside a straight and/or curved and/or bent slideway of a material of poor electrical conductivity. The term "poor electrical conductivity" takes account of the fact that according to scientific understanding all materials are electrically conductive and distinctions are only made between materials of better or poorer conductivity, the conductivity of the latter being almost zero (cf. page 522 in "Taschenbuch Elektrotechnik", Volume 1, Carl Hanser Verlag). The invention is based on the discovery that by arranging above a magnetic field generator a slideway whose form and curvature are comparable with a rotating drum, constructional adaptation is possible by simple means so an optimal eddy current separation effect can be obtained. Furthermore by the use of a slideway which is comparatively simple to manufacture and makes it possible to dispense with the rotating drum and its complicated mounting, the outlay on both the plant and on finishing and assembly are reduced considerably. The magnetic field generator, the mounting position of which can either be fixed or, preferably, adjustable, can be arranged so that the whole force of the magnetic field permeates the non-ferrous metals sliding off in the region of the slideway, in the following so-called "material throw-off zone". The material throw-off or projection zone is reached when the material to be separated falls under gravity directly on to the curved surface formed either directly by the slideway or, preferably, by a conveyor belt passing around the slideway, so that the combination of the mechanical projection forces with the forces of the magnetic field acting as late as possible on the non-ferrous metals results in the greatest widening of the trajectory parabola and thereby positive separation from the other constituents of the mixture. To generate the alternating magnetic field a magnetic rotor, or alternatively an electrically excited magnetic field generator in the form of a stationary magnetic system fed with alternating current, can advantageously be used.

In the case of a fixed slideway, preferably formed as a segment of a hollow cylinder and advantageously comprising a housing encapsulating the magnetic field generator, the very variable, possibly endless radius of curvature of a curve departing from the circular form makes a large free space available beneath the slideway which can be used for constructional purposes without however increasing the space required for the plant or the eddy current separating device, as would be the case with a drum diameter that is already slightly larger relative to the radius of curvature possible with a slideway according to the invention. Apart from the fact that a curve may even include a straight line the slideway can for example comprise one or more differently curved sections and/or straight line stretches with bends. Finally, the magnetic field generator in the form of a magnetic rotor does not need complicated mounting in a likewise rotating drum but can, for example, be mounted in the side walls of the housing made of an antimagnetic and electrically non-conductive material. The housing encapsulating the magnetic rotor protects the air gap between the magnetic rotor and the slideway from splashing water and dust, in particular Fe-dust, which increases the rotor diameter and thus prevents the air gap from becoming clogged up, which would result in friction with the inside of the slideway and thus cause overheating.

Mutual interference between the particles of the solid mixture to be separated can be almost completely prevented if on the one hand the mixture to be separated is already conveyed as far as possible beyond the crown of the slideway without interfering influences and on the other hand the repelling forces act most strongly on the non-ferrous metals precisely while the mixture is still in the material throw-off zone, and the magnetic field generator, which according to the invention can be adjusted both radially and peripherally, has a range of adjustment sufficient for all operating requirements. The solid mixture can, for example, be charged on to the desired region far beyond the crown of the slideway by means of a separate conveyor ending above the slideway by allowing the material to fall under gravity.

According to a preferred embodiment the solid mixture is however supplied from a conveyor belt guided above the slideway and preferably provided with two tail pulleys. If the front tail pulley in the transporting direction of the conveyor belt is driven, so that the conveyor belt is pulled, less force is needed than if the rear tail pulley in the transporting direction, i.e. the one located in the solid mixture feed region, were driven, pushing the conveyor belt. Furthermore when the front tail pulley is driven smaller frictional forces occur, since essentially only the friction in the region of the slideway, which should consist of non-metallic material with as low a coefficient of friction as possible, has to be overcome.

It is advantageous if the front tail pulley is adjustable. In this way the pretensioning of the conveyor belt can be influenced and a greater belt wrap angle and thus higher frictional locking of the pulling front tail pulley can be obtained. Alternatively the pretensioning of the conveyor belt can be altered by means of a take-up pulley.

If the front tail pulley is formed as a conveyor drum magnetic separator, iron components can be singled out separately at this point, particularly if the separation of iron before the eddy current separation is carried out insufficiently or not at all.

According to an advantageous embodiment the horizontal upper carrying run of the conveyor belt lies on a sliding surface. In this way a sliding belt conveyor can be obtained wherein the conveyor belt slides from the material charging point in the region of the rear tail pulley in the transporting direction to the front end of the slideway, i.e. far beyond the material throw-off zone, on a base that also supports the conveyor belt. All materials that ensure good sliding behavior but do not become electrostatically charged, such as antimagnetic stainless steel, plastics material or glass, are suitable for the sliding surface, which is preferably in the form of a trough, i.e. having side walls, extending from the rear tail pulley to the slideway. With a trough-like sliding surface the sides or side walls prevent the material from falling from the conveyor belt on its way from the feed point to the slideway. The trough simultaneously assists guidance of the conveyor belt.

According to a further embodiment a guiding body, preferably made of material with good magnetic and poor electrical conductivity and extending axially in the transporting direction, is arranged in the space beneath the slideway and above the magnetic rotor in the magnetic field of the magnetic rotor or the magnetic field generator. By a guiding body, which to avoid eddy current losses should be of a material of poor electrical but good magnetic conductivity, for example ferrite, is to be understood a body such as a flat or curved plate that deflects the lines of force from the magnetic field generator and makes possible and strengthens a magnetic shunt down towards the magnetic field generator. The lines of force from the magnetic field generator are thus guided and the magnetic field channelled. Experiments have confirmed the discovery that the magnetic field already acts on the solid mixture long before it reaches the crown, and that the components of the material prematurely undergo relative movements, so that the alternating magnetic field cannot influence these particles in the desired way on reaching the crown or the material throw-off zone, which impairs the separating effect. Because of the stationary slideway with a large radius of curvature there is however still free space available beneath the slideway—without having to increase the overall size of the plant and without the mechanical problems compared with those of a rotating drum—sufficient to accommodate, apart from the magnetic field generator, a guiding body that can preferably be adjusted both in and counter to the conveying direction. Adjustment of the guiding body makes adaptation to the position of the magnetic field generator possible.

If, as is advantageous, the guiding body extends forwards from the rear end of the slideway in the transporting direction, the solid feed mixture remains quietly on the conveyor belt, i.e. without being disturbed by the magnetic field, until it has reached the crown of the slideway and the material throw-off zone that follows, in which the full force of the magnetic field permeates the non-ferrous metals.

According to a further embodiment a directing body is arranged spaced above the curve of the slideway in the magnetic field of the magnetic field generator. It is preferably made of material with good magnetic and poor electrical conductivity. By a directing body, which can for example be a flat or curved plate, is to be understood a body that directs, i.e. attracts, the lines of force produced by the magnetic rotor toward its surface. The lines of force can thus be concentrated so that in this manner too the action of the force of the magnetic field on the non-ferrous metals in the region of the material throw-off zone is maximized.

It is advantageous if the directing body can be adjusted. If the directing body is both radially adjustable and can be swivelled on a radius about the axis of rotation or the center of motion of the magnetic field generator, its distance from the slideway or from the magnetic field generator can be adapted to the fractions contained in the solid mixture. This distance should correspond to one and a half to three times the size of the largest particles of the material being processed. Furthermore the body can be swivelled exactly into the region of the material throw-off zone.

The width of the guiding and the directing bodies is preferably the same as the width of the magnetic field generator. Thereby the action of the force of the magnetic field can be optimized over the entire region of the material throw-off zone.

It is advantageous if the guiding and the directing bodies are cooled, for which purpose these components can have cooling ribs and/or cooling pipe lines having, for example, oil flowing through. Excessive heating of the directing and/or guiding body caused by the circulation of the eddy currents can thereby be avoided.

BRIEF DESCRIPTION OF THE DRAWINGS

The invention will now explained in more detail with reference to the exemplary embodiment shown in the drawings, in which.

DETAILED DESCRIPTION OF PREFERRED EMBODIMENTS OF THE INVENTION

Figure 3:
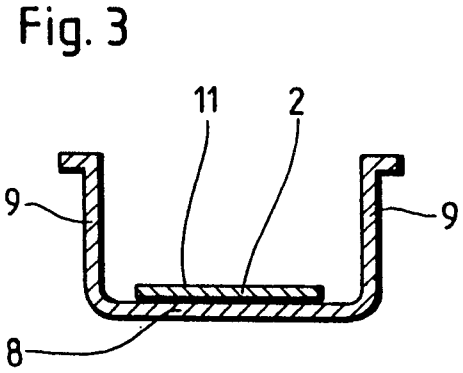
FIG. 3 shows a cross-section through a sliding surface for a conveyor belt formed as a trough arranged before the slideway as shown in FIG. 1.
Figure 1:
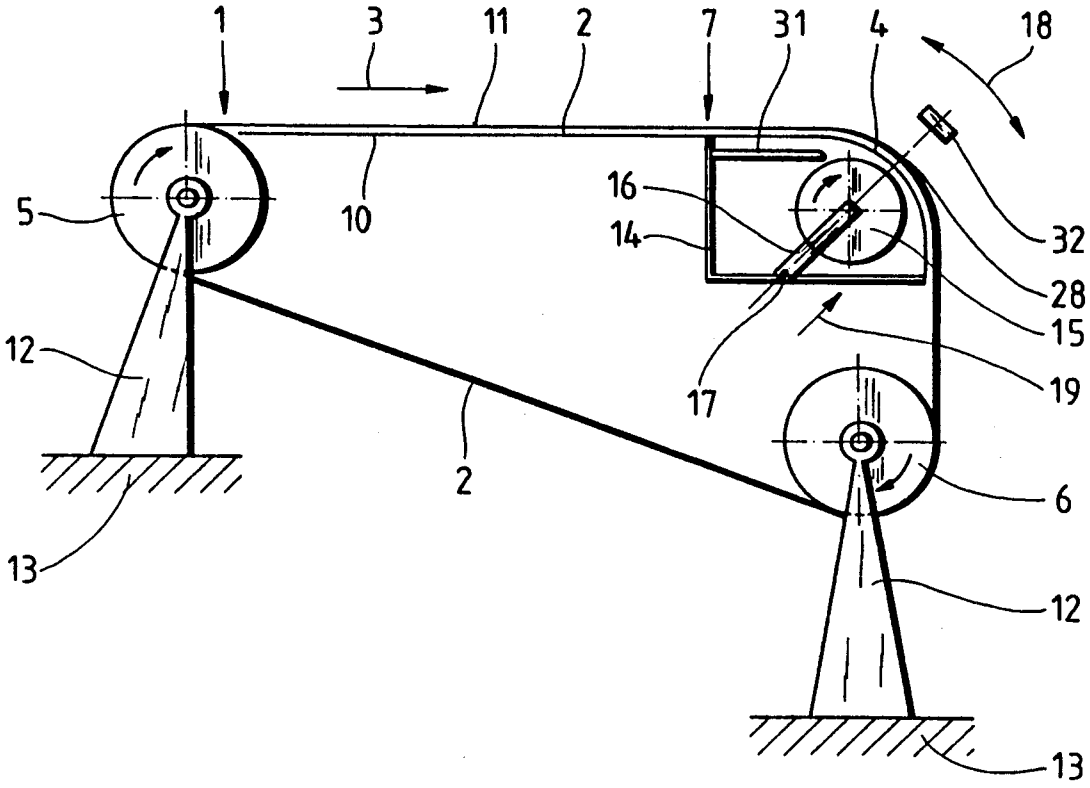
FIG. 1 shows, in a diagrammatic side elevation, an eddy current separating apparatus with a slideway according to the invention in the separating zone above a magnetic field generator in the form of a magnetic rotor therein.

In a preferred plant, within the scope of the eddy current separating apparatus according to the invention and having a belt conveyor, a solid mixture containing non-ferrous metals is delivered, as shown in FIG. 1, from a feed conveyor (not shown), for example a vibrating chute 1, on to a conveyor belt 2 at the feed end 1. The conveyor belt 2 circulates in the transporting direction 3 (see the arrow) and at the front end in the transporting direction 3 is looped around a slideway 4 formed as a quarter-segment of a hollow cylinder. The conveyor belt 2 also passes around a rear tail pulley 5 at the feed end 1 and a front driven tail pulley 6 (axial cylinder engine). In front of the slideway 4 there is a sliding surface 10, formed as a trough 8 with side walls 9 as shown in FIG. 3, that extends from the rear tail pulley 5 to the point 7 where it meets the rear end of the slideway 4 in the transporting direction 3. The sliding surface 10 and the trough 8, together with the shell-like slideway 4 that smoothly continues it, guide and support the carrying run 11 of the conveyor belt 2. The side walls 9 of the trough 8 prevent the material deposited on the conveyor belt 2 from falling off on the way from the feed end 1 to the junction 7. As shown diagrammatically in FIG. 1 for the tail pulleys 5, 6, the belt conveyor is anchored by supports 12 to the foundation 13.

Figure 2:
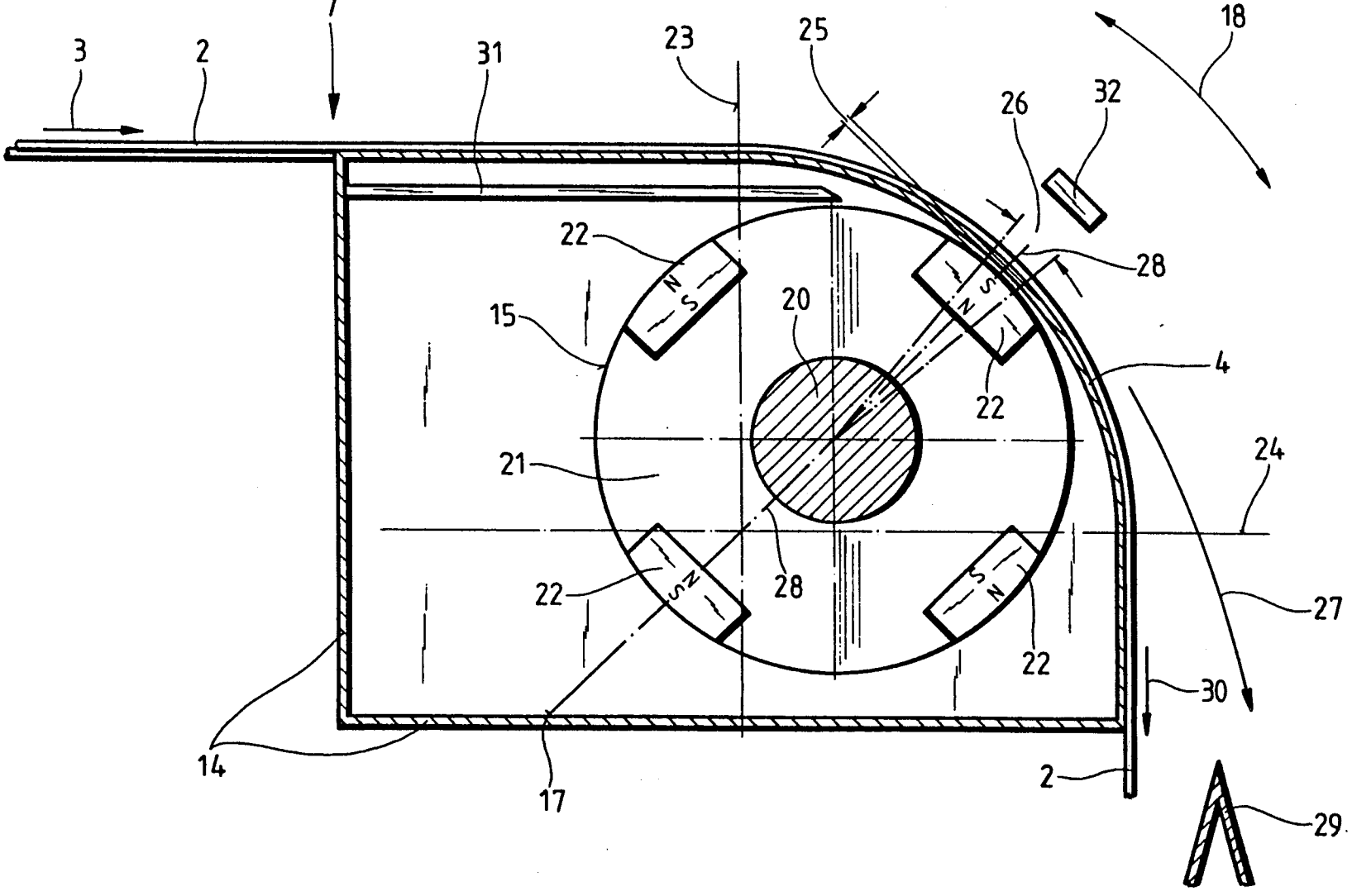
FIG. 2 shows in side elevation as a detail on an enlarged scale the magnetic rotor mounted beside the slideway shown in FIG. 1.

Adjacent to the slideway 4, beneath the plane of the conveyor belt 2, a magnetic rotor 15, which is the preferred magnetic field generator within the scope of the invention, is mounted in a closed housing 14 on a swing arm 16 so that it can be swivelled about the centre of rotation 17 of the arm in the direction of the double arrow 18. The magnetic rotor 15 is also arranged to be adjustable radially in the direction of the arrow 19 so that it can be swivelled on any desired curved path. As shown in detail in FIG. 2, the magnetic rotor 15 has rows of permanent magnets 22 fixed in its body and extending in the longitudinal direction of the rotor shaft 20, with alternate north and south polarity. The number of these poles must always be such that alternate polarity is possible. The position of the rotor shaft 20 beneath the slideway 4 in the housing 14, and thus the effective range of the permanent magnets 22, can be adjusted in the throw-off zone approximately bounded by the vertical 23 and the horizontal 24, which defines the region in which the solid mixture lying on the conveyor belt 2 begins to fall under gravity. The air gap 25 between the magnetic rotor 15 and the inner surface of the slideway 4 is smallest in this region of the material throw-off zone, which is indicated more clearly by the dash-dot lines.

The mixture transported by the conveyor belt 2 past the vertical 23 and far into the region of the throw-off zone is already in a trajectory parabola 27 which, owing to the full force of the eddy current acting at the material throw-off zone 26, which lies on the line of action 28 corresponding to the optimal effect of the magnetic rotor 15, follows the furthest-out curved path with a correspondingly great diversion of non-ferrous metals. The non-ferrous metals diverted on the trajectory parabola 27 fall selectively into a container (not shown) spaced from where the other components of the mixture are collected. The separation into valuable non-ferrous metals and other components is assisted by a separating saddle 29 of which the vertex is adjustable substantially horizontally. The latter components fall down, as shown by the arrow 30, substantially undiverted and arrive in a region in front of the separating saddle 29, viewed in the transporting direction 3.

Guiding the conveyor belt 2 in the region of the magnetic rotor 15 by means of the stationary slideway 4, formed as a quarter-segment of a hollow cylinder, over which the conveyor belt 2 is drawn by the driven tail pulley 6, creates sufficient space beneath the slideway 4 in the housing 14 to accommodate a guiding body 31, for example connected rigidly to the side walls of the housing 14. The guiding body 31 extends above the magnetic rotor 15 axially in the transporting direction 3 and makes possible a magnetic shunt downwards, back to the magnetic rotor 15, i.e. the lines of force of the alternating magnetic field produced by the magnetic rotor 15 are positively directed and channelled. This prevents the magnetic field from influencing the solid mixture lying on the conveyor belt 2 in the region between the junction 7 and the vertical 23. The components of the solid mixture thus remain undisturbed on the conveyor belt 2 until they reach the curved region of the slideway 4, where they are subjected to the maximum magnetic force in the material throw-off zone 26.

The efficiency of the separating effect is further improved, in particular if there are fractions of small particle sizes in the solid feed mixture, by placing a directing body 32 above the curve of the slideway 4 and—like the guiding body 31—extending over the entire width of the magnetic rotor 15. The directing body 32 causes the lines of force of the alternating magnetic field produced by the magnetic rotor 15 to extend up to the directing body 32, which attracts the lines of force and concentrates them in the desired manner.

Figure 4:
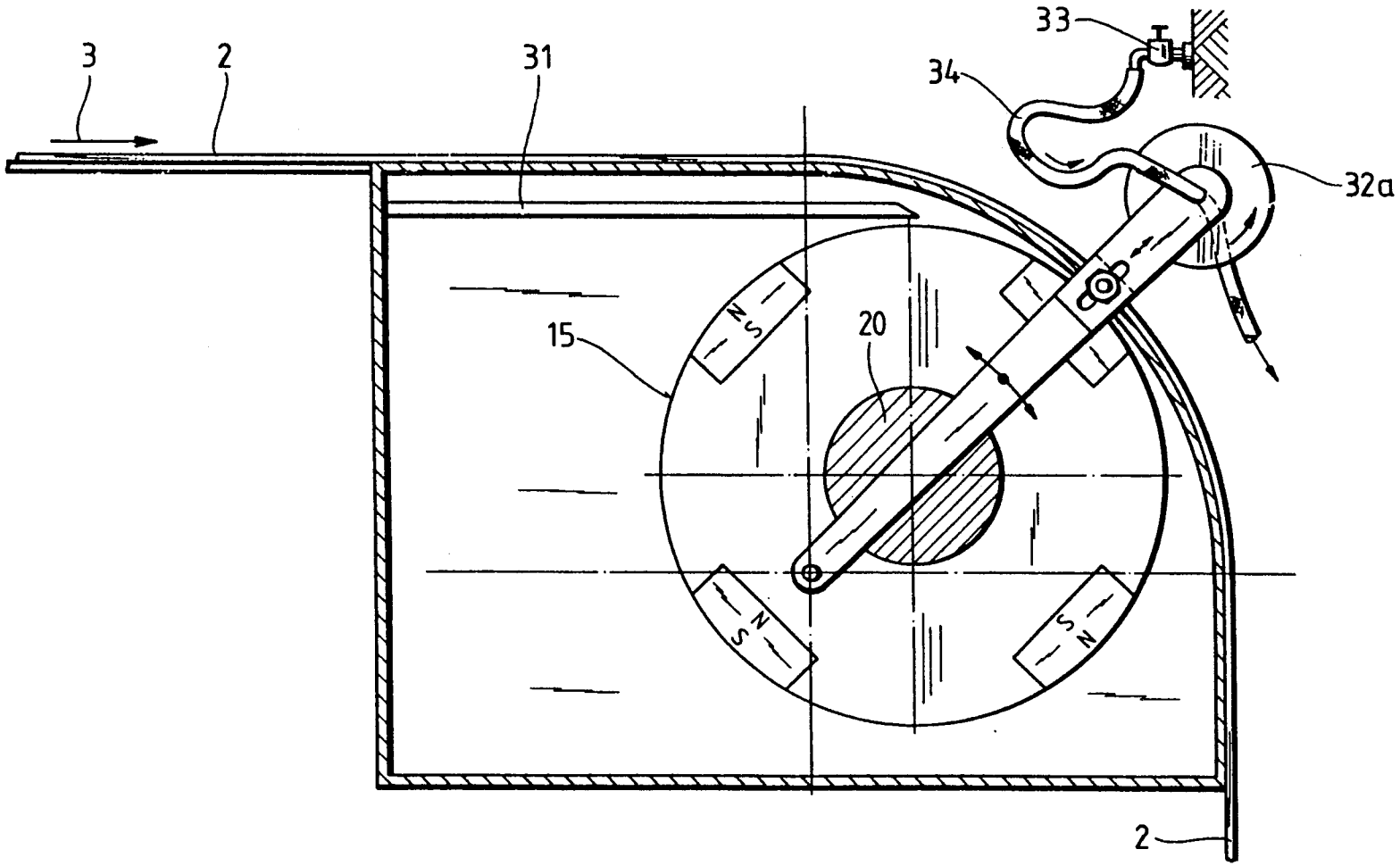
FIG. 4 shows a view similar to FIG. 2, of an alternative embodiment of the directing member, together with a cooling arrangement.

As shown in FIG. 4, the directing member is a rotor 32*a* which involves at the speed of the conveyor belt 2 and is driven by a motor. The direction member 32*a* is connected to a water supply 33 by a hose 34 so that the directing member 32*a* can be cooled with water.

Figure 5:
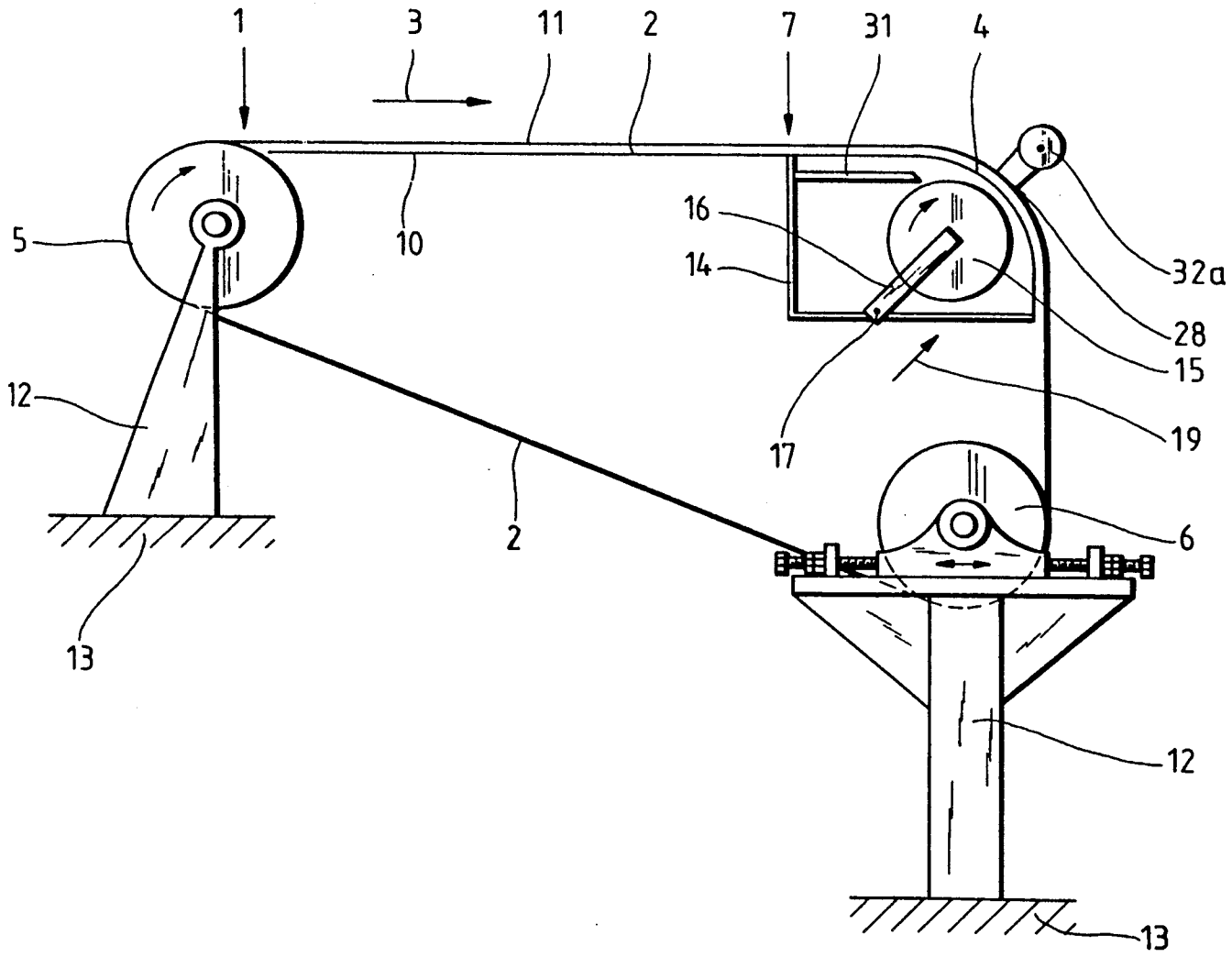
FIG. 5 shows an embodiment in which the front tail pulley is adjustable.

A front drive tail pulley 6 which is adjustable is show in FIG. 5. The mechanism for adjusting pulley 6 can take any of a number of forms known in the art.

What is claimed is:

1. An apparatus for separating non-magnetizable metals from a mixture of solid components by an alternating magnetic field, comprising:

a magnetic field generator;

a revolving conveyor belt arranged so as to feed the solid material mixture to the magnetic field generator; and a curved slideway provided at a front end of the conveyor belt, relative to a transportation direction of the conveyor belt, so that the conveyor belt loops around the slideway, the slideway being made of a material having a low electrical conductivity, the magnetic field generator being arranged at the front end of the conveyor belt next to the slideway, the slideway being a part of a housing encapsulating said magnetic field generator.

2. Apparatus according to claim 1, wherein said slideway is curved non-circularly.

3. Apparatus according to claim 1, wherein said slideway is formed as a segment of a hollow cylinder.

4. Apparatus according to claim 1, wherein the magnetic field generator is a magnetic rotor.

5. Apparatus according to claim 1, wherein the position of said magnetic field generator is adjustable.

6. Apparatus according to claim 1, wherein said conveyor belt is arranged so as to have a horizontal carrying run which runs on a sliding surface.

7. Apparatus according to claim 6, wherein said sliding surface is in the form of a trough.

8. Apparatus according to claim 6, wherein said sliding surface extends from a rear tail pulley to the slideway.

9. Apparatus according to claim 1 wherein a directing body is arranged spaced above a curve of said slideway in the magnetic field of said magnetic field generator.

10. Apparatus according to claim 9, wherein said directing body is adjustable.

11. Apparatus according to claim 9, wherein said directing body consists of a material of good magnetic but poor electrical conductivity.

12. Apparatus according to claim 9, wherein said directing body is a rotor running at about the same speed as the conveyor belt guided along said slideway.

13. Apparatus according to claim 9, wherein said said directing body has a width equal to that of said magnetic field generator.

14. An apparatus for separating non-magnetizable metals from a mixture of solid components by an alternating magnetic field, comprising:

a magnetic field generator;

a revolving conveyor belt arranged so as to feed the solid material mixture to the magnetic field generator; and a curved slideway provided at a front end of the conveyor belt, relative to a transportation direction of the conveyor belt, so that the conveyor belt loops around the slideway, the slideway being made of a material having a low electrical conductivity, the magnetic field generator being arranged at the front end of the conveyor belt next to the slideway, said conveyor belt passing around a rear tail pulley and a front tail pulley, which front tail pulley is formed as a conveyor drum magnetic separator.

15. Apparatus according to claimn 14, wherein the front tail pulley is driven.

16. Apparatus according to claim 14, wherein the front tail pulley is adjustable.

17. An apparatus for separating non-magnetizable metals from a mixture of solid components by an alternating magnetic field, comprising:

a magnetic field generator;

a revolving conveyor belt arranged so as to feed the solid material mixture to the magnetic field generator; and a curved slideway provided at a front end of the conveyor belt, relative to a transportation direction of the conveyor belt, so that the conveyor belt loops around the slideway, the slideway being made of a material having a low electrical conductivity, the magnetic field generator being arranged at the front end of the conveyor belt next to the slideway, a guiding body being arranged between the slideway and the magnetic field generator in the magnetic field of said magnetic field generator, and so as to extend in the transporting direction of the conveyor belt which is guided along said slideway.

18. Apparatus according to claim 17, wherein said guiding body consists of a material of good magnetic but poor electrical conductivity.

19. Apparatus according to claim 17, wherein said slideway has a rear region, said guiding body extending forward from the rear region of the slideway in the transporting direction.

20. Apparatus according to claim 17, wherein said guiding body is adjustable in and counter to the transporting direction.

21. Apparatus according to claim 17, wherein said guiding and said directing bodies have a width equal to that of said magnetic field generator.

22. Apparatus according to claim 17, and further comprising means for cooling at least one of said guiding and directing bodies.

23. An apparatus according to claim 17, wherein said guiding body has a width equal to that of said magnetic field generator.

* * * * *